United States Patent [19]

McPherson et al.

[11] 4,189,341

[45] * Feb. 19, 1980

[54] ENVELOPE OPENING MECHANISM

[75] Inventors: John B. McPherson, Old Lyme; William H. Gunther, Jr., Guilford, both of Conn.

[73] Assignee: Thor Dahl, Inc., New York, N.Y.

[ * ] Notice: The portion of the term of this patent subsequent to Apr. 4, 1995, has been disclaimed.

[21] Appl. No.: 838,655

[22] Filed: Oct. 3, 1977

Related U.S. Application Data

[63] Continuation of Ser. No. 599,596, Jul. 28, 1975, Pat. No. 4,082,603.

[51] Int. Cl.[2] ..... B44C 1/22

[52] U.S. Cl. ..... 156/654; 53/381 R; 156/155; 156/344; 156/345; 156/584

[58] Field of Search ..... 53/381 R; 83/912; 229/85; 156/155, 344, 584, 625, 636, 638, 639, 640, 654, 345

[56] References Cited

U.S. PATENT DOCUMENTS

| | | | |
|---|---|---|---|
| 3,116,718 | 1/1964 | Krupotich et al. | 53/381 R |
| 3,132,629 | 5/1964 | Krupotich | 53/381 R |
| 3,815,325 | 6/1974 | Berger | 156/636 X |
| 3,875,722 | 4/1975 | Russell et al. | 53/381 R |
| 4,082,603 | 4/1978 | McPherson et al. | 156/155 X |

*Primary Examiner*—William A. Powell

*Attorney, Agent, or Firm*—Dressler, Goldsmith, Clement, Gordon & Shore, Ltd.

[57] ABSTRACT

A method and mechanism for opening envelopes by chemical means.

7 Claims, 8 Drawing Figures

ENVELOPE OPENING MECHANISM

This application is a continuation of pending U.S. Application Ser. No. 599,596 filed July 28, 1975, now U.S. Pat. No. 4,082,603.

DESCRIPTION

The present invention comprises an improved method and mechanism of opening envelopes and more particularly an improved method and mechanism of chemically opening an envelope.

The present invention is an improvement over U.S. Pat. Nos. 3,677,460 and 3,816,213 owned by the assignee hereof.

As described in said issued patents, three sides of an envelope are subjected to a sensitizing agent, such as a sodium sulphate and thereafter (when the envelope is to be opened), the three sides are subjected to a developing agent such as an acid, in order to deteriorate the paper along the three edges upon the application of heat.

One of the difficulties in applying heat to the three edges is the fact that the envelopes cannot tolerate too much heat. On the other hand, there must be sufficient heat in order to permit the two chemicals to react and deteriorate the paper.

The present invention has for one of its objects the provision of an improved mechanism and method of applying sufficient heat to the edges of the envelope without deteriorating the contents thereof nor burning the envelope.

Another object of the present invention is a provision of improved mechanism and method of opening an envelope which will open envelopes continuously.

Another object of the present invention is a provision of improved mechanism and method of opening an envelope which will permit heat to be applied positively to the three edges of the envelope.

Another object of the present invention is the provision of an improved envelope opening mechanism which permits envelopes to be opened in continuous fashion.

Another object of the present invention is a provision of a mechanism and method of opening envelopes wherein improved means are provided to deliver the developing solution to the edges of the envelope.

Other and further objects of the present invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification, wherein.

Figures 1, 2, 3, 4, 5, 6, 7, 8:
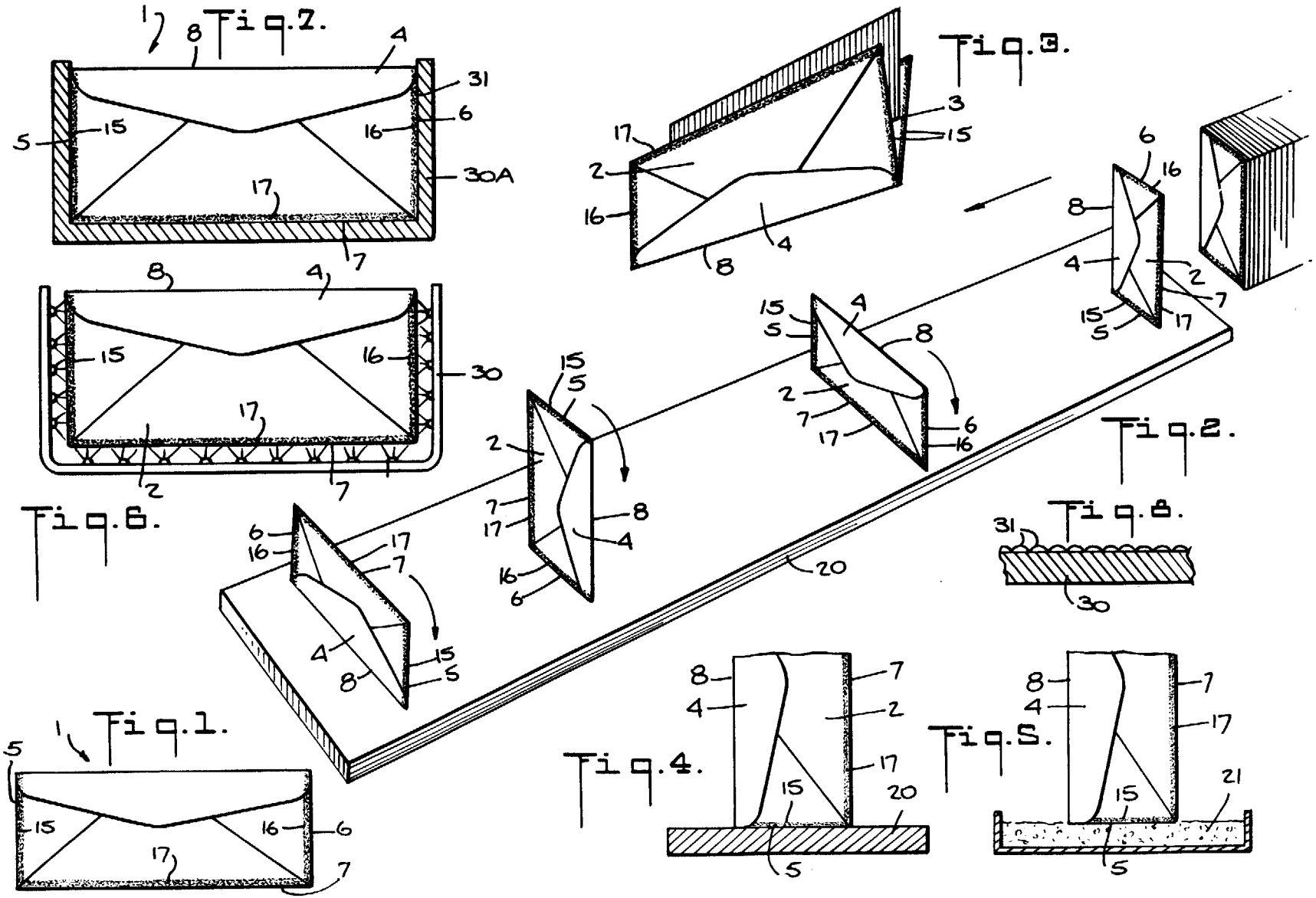
FIG. 1 is a plan view of an envelope.
FIG. 2 is a diagrammatic perspective view of the heating mechanism showing the method and mechanism for applying heat to the sensitizing areas.
FIG. 3 is a perspective view of the opened envelope.
FIG. 4 is a detail showing the heating plate as it applies heat to one edge of the envelope.
FIG. 5 is a detail similar to FIG. 3 with a different heat applying means.
FIG. 6 shows a modified method of applying developing solution to the envelope.
FIG. 7 is another modification showing a method of applying the developing solution to the envelope.
FIG. 8 is a detail showing the chemical applying means of FIG. 7.

Referring more particularly to FIG. 1, there is shown an envelope 1 which may be used with the present invention. The envelope 1 comprises the usual rear and front panels 2 and 3, respectively, and a gummed flap 4 to seal the contents of the envelope therewithin.

The envelope comprises a pair of end edges 5 and 6 and top edge 8 and bottom edge 7, respectively. In the preferred embodiment of the invention, the paper deteriorating chemicals are applied to both panels 2 and 3 along three zones 15, 16 and 17 adjacent to three edges which, as shown in FIG. 1, are the two end edges 5 and 6 and the bottom edge 7. However, the chemicals may be applied to any three edges and may also be applied to all edges, if desired. In addition, the entire envelope may be coated with the chemicals.

In U.S. Pat. No. 3,677,460 the sensitizing agent consists of a phosphate such as alkyl sodium sulfate and the developing agent comprises an organic acid such as tartaric acid or oxalic acid.

These chemicals may be applied at the time the envelope is manufactured or may be applied to the envelope at a later date. For example, the sensitizing agent can be applied at the time the envelope is manufactured and the developing chemical can be applied at a subsequent time before the heat is applied and the envelope is to be opened.

Alternatively, the chemicals can be applied one on top of each other at the time it is manufactured or at some time thereafter.

Alternatively, the developing chemicals and the sensitizing chemicals may be mixed together in a batch and the mixture applied to the three edges of the envelope or the chemicals may be applied to the entire paper from which the envelope is made. Whichever method is used to apply the chemicals, application of heat to the three edges will activate the chemicals so that they react to each other and will initiate the paper deteriorating process which opens the three edges of the envelope as shown in FIG. 3.

Referring to FIG. 2 of the drawing, the envelopes are moved along a heating plate 20 either singly or, preferably, in batches. The heating plate 20 is heated to a temperature sufficient to cause reaction to the sensitizing and developing chemicals along the zones 15 to 17 regardless of when the chemicals were applied thereto. The envelopes are fed to the heating plate 20 so that one edge, such as end edge 5 rests on and is moved across the heating plate 20, so that the edge receives sufficient heat. As the envelopes move over the heating plate 20, they are rotated 90° so the bottom edge 7 now bears on the heating plate 20. In this position, the envelopes are then moved across the plate in sufficient time for the reactions to occur and the envelopes are then rotated another 90° so that the last edge 6 is moved over the heating plate 20. All three zones have now been activated and the envelopes may, if desired, be rotated another 90° to the position shown in FIG. 3, in which position the envelope may be opened and the contents removed.

The solid plate 20 may be of any material that conducts heat, such as metal or glass. The heat may be applied to the plate 20 in any desired or conventional manner.

It will thus be seen that the envelopes 1 are moved along the heating plate 20 uniformly and continually so that at the end of the heating cycle, the envelopes 1 will be easily opened and ready to have its contents removed.

FIG. 5 shows an alternative method of applying heat to the edges. Rather than a solid plate 20, a bed of heated particulate matter 21, such as fine powder or beads may be used to apply the heat to the envelopes 1. In all other respects, the envelopes would be manipulated in the same manner as described in connection with the embodiment shown in FIG. 2.

In addition, while the plate 20 has been shown to be solid, it is possible that the plate 20 may be made of mesh or grid material which can be heated.

FIG. 6 shows one method of applying the developing solution to the edge of the envelopes 1. With the sensitizing solution on the edges, the developing solution can be sprayed against the three edges by a U-shaped spray machine 30, as shown diagrammatically in FIG. 6. It will be understood that the sensitizing solution can be applied in the same manner.

FIGS. 7 and 8 show another manner of applying the developing and/or the sensitizing solution to the envelopes 1. In this embodiment, the chemical may be applied by encapsulating the chemical in a U-shaped sheath 30 which embraces the envelope 1 and which has minute capsules 31 along its inner face, as shown diagrammatically in FIG. 8. The desired chemicals are encapsulated in the capsules 31 in aqueous solution. The method of producing such encapsulating material is shown in U.S. Pat. No. 3,674,704.

In the particular embodiment of the present invention, the acid used should be about 10% of the composition with the other part of the composition comprising glycerin in water in a ratio of fifty to fifty. With this embodiment, the chemical which has been encapsulated in the thin microscopic capsules 31 is applied to the envelope 1 when the envelope 1 brushes against capsules 31. The thin members of the capsules 31 will break so that the interior chemicals will escape and be applied to the three edges 5, 6 and 7 of the envelope 1. Such encapsulated material can be made in sheets and stored until ready for use.

The chemicals used therein may be sodium propyl sulfate for the sensitizing chemical and 2½% tartaric acid for the developing chemical.

In addition to tartaric acid as the developing agent, oxalic acid, malonic and maleic acid will also work although tartaric acid appears to be the preferable form to use. The most common form of tartaric acid is d-tartaric acid which is a by-product of the wine industry and which can be purchased at relatively pure grade (Macalester-Bicknell TX15 Tartaric Acid, N. F., Crystals). If other acids are to be used, then the solution will be 10% for oxalic acid and 8% for malonic or maleic acid. All of these solutions are soluble in propanol or in water although propanol solution may work, it appears important that some water be available for the hydrolysis of sodium n-propyl sulfate. The amount of water naturally absorbed in water may be sufficient but if it is not, some water may be added to the propanol solution.

If alkyl sodium sulfate is used, the lower molecular weight alkyl compounds, such as n-propyl and hexyl compounds are preferred over the higher weights. One example of a usable higher molecular weight compound is sodium lauryl sulfate which is a dodecyl compound available in the trade in "Stepanol WA" and "Duponol WAQ". The compound of choice is n-propyl sodium sulfate. It may be present to the extent of 10% in an isopropyl alcohol solution which may also comprise about 10% water. It will thus be seen that the present invention comprises an improved method and mechanism for opening the envelopes in a continuous and positive and fast way which does not involve great losses of heat nor require manual handling of the envelopes nor complicated machinery for moving the envelopes from one end to the other.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described the invention, it is claimed:

1. The process of opening an envelope which has been previously treated along three edges with sensitizing and developing agents comprising resting a first treated edge of said envelope on a flat heating means, moving the envelope over said heater while the said first edge is in contact with and resting on the heater so that heat may be applied to the first edge, rotating the envelope 90° to place a second treated edge of the envelope in contact with and resting on the heater, moving said envelope over the heater while the said second edge is in contact with and resting on the heater so that heat may be applied to said second edge, rotating the envelope another 90° so that a third treated edge is placed in contact with and resting on the heater, moving said envelope over said heater while said third edge is in contact with and rests on said heater so that heat may be applied to said third edge whereby the heat applied will deteriorate the said edges, the edges being moved over the heater continuously and without interruption.

2. A process as claimed in claim 1 wherein the heating means is a solid plate against which the edges are moved.

3. A process as claimed in claim 1 wherein said heating means comprises heated particulate material against which the edges are moved.

4. A mechanism of opening an envelope which has been previously treated along three edges with sensitizing and developing agents comprising flat heater means, means for resting a first treated edge of said envelope on said heater, means for moving the envelope over said heater while the said first edge is in contact with and resting on the heater so that heat may be applied to the first edge, means for rotating the envelope 90° to place a second treated edge of the envelope in contact with and resting on said heater, means for moving said envelope over the heater while the said second edge is in contact with and resting on the heater so that heat may be applied to said second edge, and means to rotate the envelope another 90° so that a third treated edge is placed in contact with and resting on said heater, means for moving said envelope over said heater while said third edge is in contact with and rests on said heater so that heat may be applied to said third edge whereby the heat applied will deteriorate the said edges, said movement of the edges over the heater being continuous and uninterrupted.

5. A mechanism as claimed in claim 4 wherein the heating means is a solid plate against which the edges are moved.

6. A mechanism as claimed in claim 4 wherein said heating means comprises heated particulate material against which the edges are moved.

7. A mechanism for opening an envelope which has been previously treated along three sides comprising a heating means, means for continuously moving an edge of an envelope relative to said heating means and in contact therewith so that heat may be applied to the edge, means for rotating the envelope 90° so that one other edge of the envelope is in contact with and moved relative to the heat means, means to rotate the envelope another 90° so that a third edge is in contact with and moves relative to the heat means, means for rotating the envelope an additional 90° before being opened, means for moving the envelope relative to the heat means in batches, said batches being loosely held so that the edges will drop on to the heating element, and wherein a treating chemical is applied to the edges from an encapsulating sheet having microscopic capsules, the encapsulated sheet being U-shaped in order to embrace three edges of the envelope, whereby the capsules therein are broken by pressure from the envelopes.

* * * * *